US005697031A

United States Patent [19]

Kamiya et al.

[11] Patent Number: 5,697,031

[45] Date of Patent: Dec. 9, 1997

[54] IMAGE FORMING APPARATUS AND METHOD FOR OVERLAID TRANSFER OF IMAGES

[75] Inventors: Takuro Kamiya, Tokyo; Shinichi Namekata, Kanagawa, both of Japan

[73] Assignee: Ricoh Company, Ltd., Tokyo, Japan

[21] Appl. No.: 692,779

[22] Filed: Jul. 2, 1996

[30] Foreign Application Priority Data

Aug. 4, 1995 [JP] Japan ..... 7-199673

[51] Int. Cl.[6] ..... G03G 15/01

[52] U.S. Cl. ..... 399/301; 399/66; 399/302

[58] Field of Search ..... 399/302, 308, 399/66, 50, 301, 297, 168, 170

[56] References Cited

U.S. PATENT DOCUMENTS 5,040,028 8/1991 Kamimura et al. ..... 399/302
5,499,092 3/1996 Sasaki ..... 399/302

FOREIGN PATENT DOCUMENTS 4-50987 2/1992 Japan .
7-72701 3/1995 Japan .
7-92763 4/1995 Japan .

*Primary Examiner*—S. Lee
*Attorney, Agent, or Firm*—Lowe, Price, Leblanc & Becker

[57] ABSTRACT

An apparatus having a photosensitive body and intermediate transfer body for successively transferring color toner images formed on the photosensitive body onto the intermediate transfer body to form an overlay transfer image which is transferred in batch onto transfer paper. Passage of a mark in a portion of the intermediate transfer body is detected by a mark detector in a passage area for the mark. A primary transfer device is provided in a primary transfer section of the appartus so as to contact the photosensitive body. An electrifying device is provided at a position of upstream in a rotating direction of the photosensitive body from the primary transfer device. A control device provides control such that in a standby state prior to starting the image forming, the distance from the mark detector to the downstream mark, viewed with respect to the direction of rotation of the intermediate transfer body, is always longer than a corresponding distance of the photosensitive body from a downstream position of the electrifying device with respect to the direction of rotation of the photosensitive body to the primary transfer section.

21 Claims, 10 Drawing Sheets

IMAGE FORMING APPARATUS AND METHOD FOR OVERLAID TRANSFER OF IMAGES

FIELD OF THE INVENTION

The present invention relates to an image forming apparatus, and more particularly to an image forming apparatus having a photosensitive body and an intermediate transfer body and of a type in which a color toner images formed on the photosensitive body are successively transferred onto the intermediate transfer body in an overlaid form to form an overlaid transfer image and then this overlaid transfer image is transferred in batch onto transfer paper.

BACKGROUND OF THE INVENTION

There has been known an image forming apparatus having a photosensitive body comprising a rotary body rotated and driven, an intermediate transfer body provided at a position opposite to the photosensitive body and rotated at the same speed as that of said photosensitive body in a state where it is contacted to said photosensitive body, a mark provided in a portion of this intermediate transfer body, and a sensor for detecting said mark provided in a passage area of said mark, and also having a primary transfer means in a primary transfer section constituting a state where it contacts said photosensitive body and an electrifying means at an electrifying position located upstream in the direction in which said photosensitive body rotates from a position where said primary transfer means is located; wherein an image forming process is started in a certain period of time after said mark is detected by said sensor during rotation of said photosensitive body as well as of said intermediate transfer body when an image is formed, a toner image for a given color is formed by optically writing in an electrifying zone of said photosensitive body having passed said electrifying position and also having been electrified and developing the latent image, and the toner image with the given color is transferred by the primary transfer means in said primary transfer section onto said intermediate transfer body, then above steps are repeated to each different color to obtain a color toner image on said intermediate transfer body and this overlaid toner image is transferred in batch onto transfer paper to obtain a color image.

In the image forming apparatus as described above, there may occur a case in which, for instance, a mark detection by a sensor is executed in an image forming process for a first color, an image forming process is started in a certain period of time after the mark is detected, and in optical writing to a photosensitive body, a preceding section not electrified yet passes at primary transfer section and then an electrified section passes there.

In the primary transfer section, a photosensitive body and an intermediate transfer body closely adhere to each other to form a so-called nip section, and an adhesive force between the photosensitive body and the intermediate transfer section due to an electric force (Coulomb force) in a state where a section not electrified yet closely adheres to the intermediate transfer body is different from that in a state where an electrified section closely adheres to the intermediate transfer body, and in association with this change, also a driving load for the photosensitive body or the intermediate transfer body changes.

For this reason, a driving load for a photosensitive body or an intermediate transfer body when a not-electrified section of the photosensitive body passes the primary transfer section is different from that when an electrified section of the photosensitive body passes there, and this load fluctuation appears as a change in linear speed.

The fluctuation in speed as described above can be generated during an operation for optically writing in an image forming process for a first color when a boundary between an electrified section and a not-electrified section passes the primary transfer section. In this case, extension or compression of an image due to speed change occurs in an image for the first color, and as an electrified section always passes the primary transfer section in an image forming process for a second color, positional displacement between an image for the first color and that for the second color is generated.

Also in a case where a not-electrified section passes the primary transfer section during an operation for optically writing in an image forming process for the first color and an electrified section passes the primary transfer section during an operation for optically writing in an image forming process for a second color, as a load for the photosensitive body or the intermediate transfer body in the image forming process for the first color is different from that in the image forming process for the second color, positional displacement in the images is generated.

SUMMARY OF THE INVENTION

It is an object of the present invention to provide an image forming apparatus which can eliminate positional displacement in an image caused by passage of a not-electrified section through a primary transfer section.

To achieve the object as described above, the present invention provides an image forming apparatus having a photosensitive body and an intermediate transfer body for successively transferring color toner images each formed on the photosensitive body onto the intermediate transfer body in an overlaid form to form an overlaid transfer image and transferring the overlaid transfer image in batch onto transfer paper; the image forming apparatus comprising: a mark provided in a portion of the intermediate transfer body; a mark detecting means provided in a passage area for the mark and detecting passage of the mark; a primary transfer means provided in a primary transfer section constituting a state in which the primary transfer means contacts the photosensitive body; an electrifying means provided at a electrifying position upstream in the rotating direction of the photosensitive body from the position of the primary transfer means; and a control means for providing controls so that, in the stand-by state prior to start of the image forming process, a distance from the mark detecting means in the downstream direction to the mark is always kept longer in the rotating direction of the intermediate transfer body as compared to a distance in the rotating direction of the photosensitive body from the electrifying position in the downstream direction to the primary transfer section.

Also the present invention provides an image forming method with an image forming apparatus having a photosensitive body and an intermediate transfer section for forming a transfer image by successively transferring color toner images formed on the photosensitive body onto the intermediate transfer body in an overlaid form and transferring the transfer image onto transfer paper in batch; the image forming apparatus having a mark provided in a portion of the intermediate transfer body, a mark detecting means provided in a passage area for the mark and detecting passage of the mark, a primary transfer means provided in a primary transfer section constituting a state in which the primary transfer means contacts the photosensitive body, and an electrifying means provided at a electrifying position upstream in the rotating direction of the photosensitive body from the located position of the primary transfer means; wherein control is provided in the stand-by state before start of the image forming process so that a distance from the mark detecting means to the mark located at a position downward in the direction in which the intermediate transfer body rotates is always kept longer than a distance from the electrifying position to the primary transfer position located at a position downward from the former in the direction in which the photosensitive body rotates.

Other objects and features of this invention will become understood from the following description with reference to the accompanying drawings.

DESCRIPTION OF THE PREFERRED EMBODIMENTS

Figure 12:
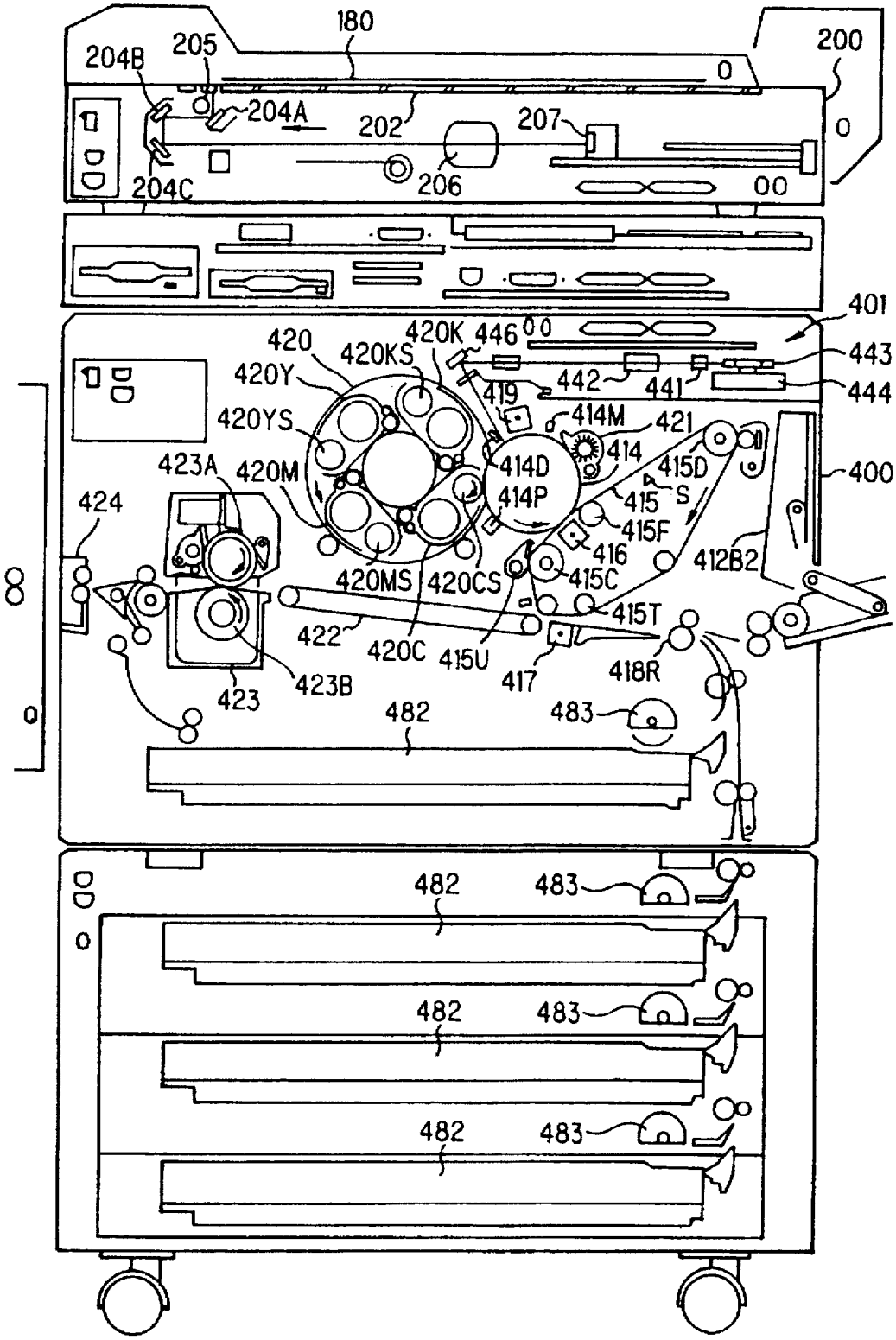
FIG. 12 is an explanatory view showing general configuration of the image forming apparatus preferable for carrying out the present invention.

Next description is made for a color image forming apparatus as an example of the multi-color image forming apparatus suited for application of the present invention therein with reference to FIG. 12.

A color image reader (described as color scanner hereinafter) 200 forms an image of a document 180 placed on a contact glass 202 via an illuminating lamp 205, a group of mirrors 204A, 204B, 204C, and a lens 206 onto a color sensor 207, reads color image data of the document for each of separated colors such as, for instance, blue (described as B hereinafter), green (described as G), and red (described as R), and converts the color image data to electric image signals.

The color sensor 207 comprises, in this example, a color separating means for separating an image into the three colors of B, G, and R and a photoelectric conversion element such as a CCD (charge coupled device), and reads image data for the three colors simultaneously.

A color conversion processing is executed in an image processing section (not shown herein) depending on color-separated image signal amplitude levels for B, G, and R obtained by the color scanner 200, and color image data including color data of black (described as BK), cyan (described as C) and magenta (described as M), and yellow (described as Y) is obtained.

To obtain image data for BK, C, M, and Y by using the color image data and with a color image recording device 400 (described as color printer hereinafter), when the color scanner 200 receives a scanner start signal synchronized to an operation of the color printer 400, an illumination/mirror optical system comprising the illumination lamp 205 and a group of mirrors 204A, 204B, 204C scans the document in the direction indicated by the leftward arrow shown in FIG. 12, and image data for one color is obtained in each scan. And each time the color data is converted to a visible image with the color printer 400 successively, thus color data for each color being overlaid and a full color image consisting of four colors being obtained.

Then description is made for general configuration of the color printer 400.

An optical unit 401 for writing as an exposure means converts color image data from the color scanner 200 to an optical signal, executes an operation for optically writing in response to a document image, and forms a electrostatic latent image on a photosensitive drum 414 as a latent image carrier which is a photosensitive body defined in the present specification.

The optical unit 401 for optically writing comprises a laser emitting means 441, a light emission driving/controlling section for driving the laser emitting means 441 (not shown herein), a polygon mirror 443, a motor 444 for rotating the polygon mirror 443, a fθ lens 442, and a reflection mirror 446.

The photosensitive drum 414 rotates counterclockwise as indicated by the arrow mark, and provided around the photosensitive drum 414 are such components as a photosensitive body cleaning unit 421, a discharging lamp 414M, an electrifier 419 as an electrifying means, a electric potential sensor 414D for detecting an electric potential of a latent image on the photosensitive drum, a revolver developing unit 420 selected as a developer, a development density pattern detector 414P, and an intermediate transfer belt as an intermediate transfer body as defined in the present invention.

The revolver developing unit 420 comprises a BK developer 420K, C developer 420C, M developer 420M, a Y developer 420Y, and a revolver rotating/driving section (not shown herein) for rotating each developer counterclockwise as indicated by the arrow mark. Each of the developers comprises development sleeves 420KS, 420CS, 420MS, 420YS each rotating in a state where a tip for developing solution is contacted to a surface of the photosensitive drum 414 to develop the electrostatic latent image and a development puddle rotating for pumping up and agitating the developing solution.

In the stand-by state, the revolver developing unit 420 is set in a position where development is executed with the BK developer 420, and when a copying operation is started, the color scanner 200 starts scanning the BK image data at a specified point of time, and then optically writing with a laser beam and formation of a latent image is executed depending on the image data (The electrostatic latent image based on the BK image data is described as BK latent image. The same is true for each of C, M, and Y image data).

To enable development of the BK latent image from its tip section, rotation of the development sleeve 420KS is started before the tip section of the latent image reaches a development position for the BK developer 420K, and the BK latent image is developed with BK toner.

Then an operation for development of the BK latent image area is continued, but at a point of time when a rear edge section of the latent image passes the BK latent image position, the revolver developing unit 420 is quickly driven and rotated from the position for development with the BK developer 420K to a position to development with a developer for the next color. This rotating operation is finished, at latest, before a tip section of a latent image based on the next image data reaches there.

When a cycle of image formation is started, the photosensitive drum 414 rotates counterclockwise as shown by the arrow mark, while the intermediate transfer belt 415 is rotated clockwise by a driving motor not shown herein.

In association with rotation of the intermediate transfer belt 415, formation of a BK toner image, formation of a C toner image, formation of an M toner image, and formation of a Y toner image are executed successively, and finally toner images are formed in a overlaid form on the intermediate transfer belt 415 in the order of BK, C, M, and Y.

Formation of a BK image is executed as described below.

The electrifier 419 homogeneously electrifies the photosensitive drum 414 with a negative electric charge to around −700V in darkness by means of corona discharge. Then the laser diode 441 executes luster exposure according to a BK signal. When the luster image is exposed as described above, at first in an exposed portion of the photosensitive drum 414 having been electrified homogeneously, an electric charge in proportion to a quantity of light used for exposure disappears, and an electrostatic latent image is formed there.

Toner in the revolver developing unit 420 is electrified to a negative polarity due to agitation with a ferrite carrier, and the BK development sleeve 420KS in this developing unit is biased against a metallic base layer of the photosensitive drum 414 to an electric potential where a negative DC current and an alternative current are superposed by a power means not shown herein.

As a result, in a portion where an electric charge on the photosensitive drum 414 is still remaining, toner is not adhered, while the BK toner is adhered to a portion without any electric charge, namely the exposed portion, and for this reason a BK visible image similar to the latent image is formed.

The intermediate transfer belt 415 is spanned over a driving roller 415D, an resisting roller 415T for transfer, and a resisting roller 415C for cleaning, and a group of following rollers, and is driven and controlled by a driving motor not shown herein.

By the way, the BK toner image formed on the photosensitive drum 414 is transferred by a belt transfer corona discharger 416 (described as belt transfer section hereinafter) onto a surface of the intermediate transfer belt 415 being driven at the same speed as that of the photosensitive body being contacted thereto. The sequence for transferring a toner image from the photosensitive drum 414 to the intermediate transfer belt 415 is described as belt transfer.

A small quantity of residual toner not having been transferred and remaining on the photosensitive drum 414 is cleaned off with the photosensitive body cleaning unit 421 in preparation for re-use of the photosensitive drum 414. The toner recovered in this step is stored via a recovering pipe in a wasted toner tank not shown herein.

It should be noted that BK, C, M and Y toner images successively formed on the photosensitive drum 414 are successively transferred at a same place on a same plane of the intermediate transfer belt 415 to form a belt transfer image with color images for four colors overlaid therein, and then the belt transfer image is transferred in batch with a corona discharge transfer unit onto transfer paper.

On the other hand, in the side of the photosensitive drum 414, next to a process for forming a BK image, system control goes to a process for forming a C image, but an operation for reading C image data with the color scanner 200 is started at a specified period of time, and formation of a C latent image is executed by optically writing the image data with a laser beam.

After a rear edge section of the preceding BK latent image passes the developing position and also before a front edge of the C latent image reaches the point, the C developer 420C rotates the revolver developing unit and develops the C latent image with C toner.

Then development of the C latent image area is continued, and at a point of time when a rear edge of the latent image passes the developing position, the revolver developing unit 420 is driven like in a case of the BK developer described above to feed out the C developer 420C, and the next M developer 420M is positioned at the developing position. Also this operation is executed before a front edge section of the next M latent image section reaches a developing section. It should be noted that operations for reading, forming a latent image and development for forming M and Y images are executed like in a case of formation of the BK image or C image described above, and the description thereof is omitted herein.

A belt cleaning device 415U comprises an entrance seal, a rubber blade, a discharge coil, and a mechanism for moving to and away from the entrance seal and the rubber blade. After the BK image for the first color is transferred onto a transfer belt, while images for second, third, and fourth color are being transferred onto the belt, the entrance seal and rubber blade are moved away from a surface of the intermediate transfer belt by the blade moving mechanism.

A corona discharger 417 for transfer onto paper (described as paper transfer unit) is based on a corona discharging system to transfer an overlaid toner image on the intermediate transfer belt 415 and loads AC+DC or DC component onto transfer paper and to the intermediate transfer belt. Transfer paper having various sizes is accommodated in a transfer paper cassette 482 in the feed paper bank, and the paper is fed and transferred to the resist roller pair 418R with the paper feed roller 482 from the accommodation cassette with paper having a specified size accommodated therein. It should be noted that the reference numeral 412B2 indicates a paper feed tray for manually feeding OHP paper or thick paper.

At a point of time when image formation is started, transfer paper is fed from either one of the paper feed trays and is held in the stand-by state in a nip section of the resist roller pair 418R. And at a point of time when a front edge of a toner image on the intermediate transfer belt 415 reaches an edge of the paper transfer unit 417, the resist roller pair 418R is driven so that the front edge of the transfer paper is aligned to a tip section of this image, thus alignment between the paper and the image being executed.

Thus the transfer paper is overlaid over the overlaid color image on the intermediate transfer belt and passes by the paper transfer unit 417 connected to a positive electric potential. Then positive electric charge is loaded to the transfer paper with a corona discharge current, and most of the toner image is transferred onto the transfer paper. Then, when the transfer paper passes through a separator/electric charge remover consisting of an electric charge removing brush not shown herein and located in the left side of the paper transfer unit 417, electric charge is removed from the transfer paper, which is separated from the intermediate transfer belt 415 and transferred onto a paper carriage belt 422.

The transfer paper with a four-color overlaid toner image transferred in batch thereto from a surface of the intermediate transfer belt is carried by the carriage belt 422 to a fixing unit 423 with the toner image melt and fixed in nip sections in the fixing roller 423A and pressurizing roller 423B each controlled to a specified temperature, and then sent out of the basic body with the discharging roller pair 424, stacked with the top surface put upward in a copy tray not shown herein, thus a full color copy being obtained.

A surface of the photosensitive drum 414 with the toner image having been transferred onto a transfer belt therefrom is cleaned by the photosensitive cleaning unit 421 comprising a brush roller and a rubber blade, and also electric charge is removed homogeneously from the surface thereof with the electric charge removing lamp 414M.

Also a surface of the intermediate transfer belt 415 with the toner image having been transferred therefrom onto transfer paper is again cleaned by pushing a blade of the cleaning unit 415U thereto with the blade moving mechanism.

When copied are to be prepared repeatedly, operations of the color scanner and formation of an image on the photosensitive body are shifted at a specified point of time, in succession to a step for forming an image for the fourth color of the first sheet of copy, to a step of forming a color image for the first color of the second sheet of copy.

In the side of the intermediate transfer belt 415, in succession to a step of transferring the four-color overlaid image for the first sheet in batch to transfer paper, a BK toner image for the second sheet is transferred onto an area of the transfer belt having been cleaned with the belt cleaning unit. Then the same operations as those for the first sheet are repeated.

What was described above is for a copy mode for obtaining a full color copy of an image consisting of four colors, but in a case of three-color copy mode or two-color copy mode, the same operations as those described above are executed for a specified number of colors by specified times.

In a case of a single color copy mode, until a specified number of copies are prepared, only a developer for a specified color in the revolver developing unit 420 is positioned at a developing position for the specified color and set in the state ready for development, and copying operations are executed continuously with the blade of the belt cleaning unit 415 being pushed against the belt.

With the image forming apparatus as described above, a mark for positional detection is provided on an outer peripheral surface of the belt 415 or on an inner peripheral surface thereof. It should be noted that, if the mark is provided on the outer peripheral surface, the passage area of the belt cleaning unit should be evaded, which sometimes may cause difficulty in allocation of the mark, and in that case the mark should be provided on the inner peripheral surface. An optical sensor not shown herein is provided at a position between the driving roller 415D and a supporting roller 415F each supporting the belt 415.

Figure 1:
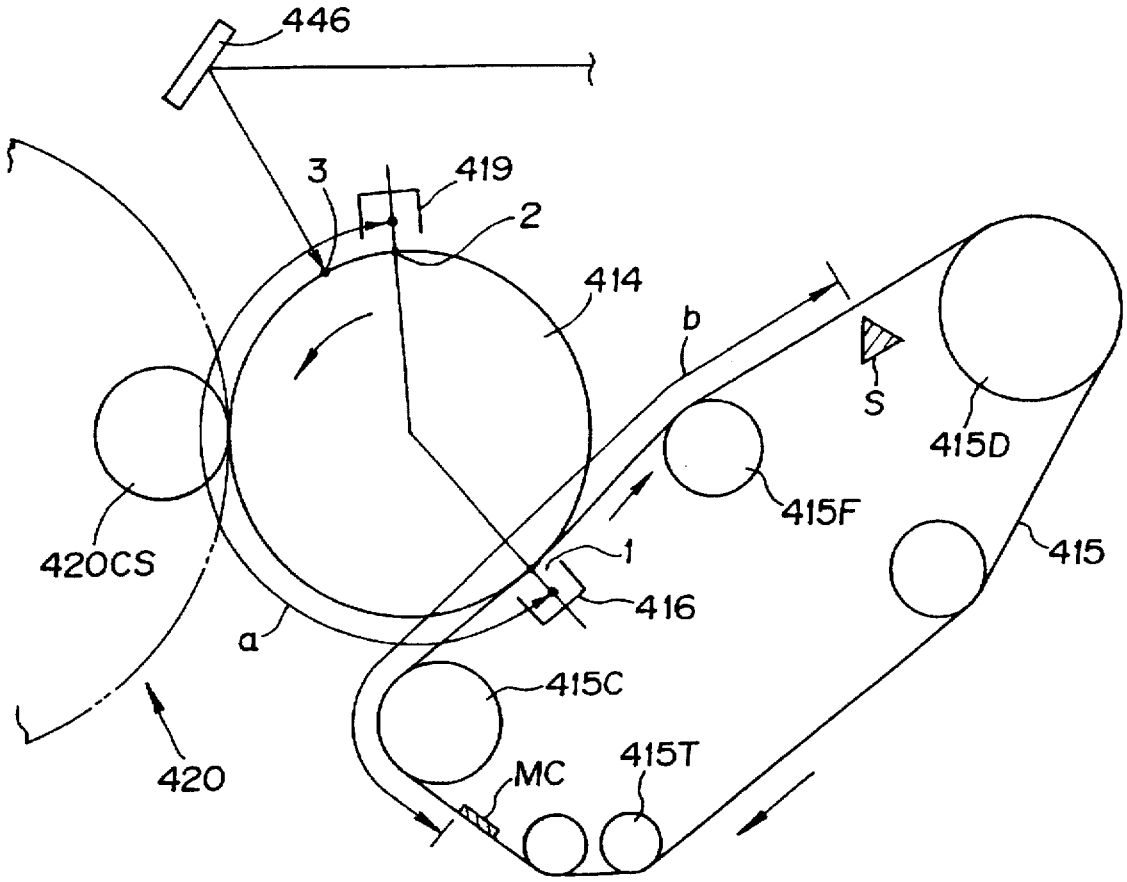
FIG. 1 is an enlarged front view showing a combination of a photosensitive drum with an intermediate transfer body in the image forming apparatus according to the present invention.

FIG. 1 shows an enlarged view of a key section of the configuration shown in FIG. 12. In FIG. 1, the photosensitive drum 414 and the intermediate transfer belt 415 are rotated at the same linear speed in the primary transfer section where the belt transfer section 416 as a primary transfer means is located therein, as indicated by the arrow mark.

A mark MC is provided on the rear side of the intermediate transfer belt 415. A sensor S for reading this mark MC is provided on a fixed member in the passage area of this mark MC moving together with the intermediate transfer belt 415.

When forming an image, the mark MC is detected by the sensor S during rotation of the photosensitive drum 414 as well as of the intermediate transfer belt 415, and in a specified period of time (at a specified point of time) after detection of this mark MC, the image forming process is started, optically writing with a light beam irradiated via a reflection mirror 446 is executed to an electrified area of the photosensitive drum 414 having passed through the electrifier 419 and having been electrified, and the BK image is developed by the revolver developing unit 420. The position for writing is indicated by the reference numeral 3.

Then a step of transferring the BK toner image with the belt transfer section 416 onto the intermediate transfer belt 415 is executed in the primary transfer section 1. When a full color image is formed, in succession to formation of the BK toner image, toner images for other colors are successively transferred onto the intermediate transfer body in an overlaid form according to a processing sequence similar to that for forming the BK toner image in the order of images for C, M, and Y, and finally the overlaid toner image is transferred in batch onto transfer paper with the transfer pair roller 415T.

In this embodiment, the distance from a electrifying position 2 where the electrifier 419 is located in the direction in which the photosensitive drum 414 rotates to the primary transfer section located downward from the former in the direction indicated by the arrow mark measured in the stand-by state before start of the image forming process described above is defined as distance a. Also the distance from the sensor S to the mark MC located downward from the former in the direction in which the intermediate transfer belt 415 rotates as indicated by the arrow mark is defined as distance b. And the relation of b>a is always maintained.

Herein the stand-by state before start of the image forming process is defined as the initial state when first image formation is executed, and this state is the same as that when, after end of an image formation job, each member is positioned at the initial position for the first image forming process and operation of the machine is stopped. Also the stand-by state is the same as that after initialization in a case where, for instance, each component of the machine is stopped during its operational sequence for image formation due to such a trouble as power failure and the component is initialized and set in the stand-by state.

With the conditions as described above, when an image forming process is started, a period of time bt required from the mark MC to move from the stopped position to a position of the sensor S can be made longer by a given period of time ct as compared to a period of time at for a front edge section of an area electrified by the electrifier 419 to reach the primary transfer section 1.

For this reason, electrification by the electrifier 419 is started in a certain period of time after the mark MC is detected with the sensor S, and then image formation for the first color by optically writing is started. While the operation for optically writing image data for the first color is being executed, a front edge section of an area having passed through the electrified 419 and having been electrified thereby is passing through the primary transfer section 1. For this reason, a sequence of image forming process is executed in the state where the adhesion force between the photosensitive drum 414 and the intermediate transfer belt 415 is always kept at a constant level, and change in a speed of the photosensitive drum 414 as well as of the intermediate transfer belt 415 does not occur, so that positional displacement between color images due to change in the speed, which has been a problem in the conventional technology, does not occur.

Herein in the stand-by state before start of the image forming process, a positional relation between each component must be adjusted previously so that the position, at which the mark MC stops, will not be in a belt portion of each roller supporting the intermediate transfer belt 415. If the mark MC is in any belt portion of the roller and is left in the state for a long time, the mark is distorted due to plastic distortion of the belt, which may cause a timing error in detection of the mark with the sensor S.

Figure 2:
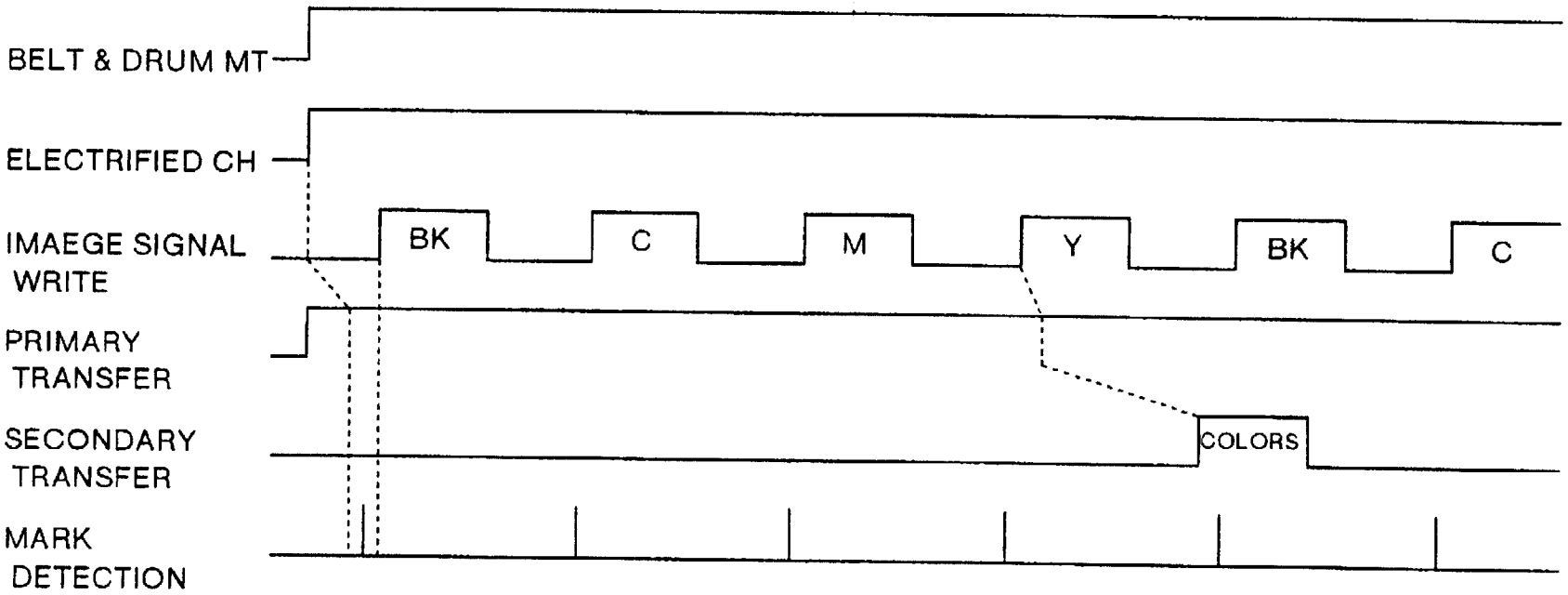
FIG. 2 is a timing chart showing operations of the image forming apparatus shown in FIG. 1.

Next concrete description is made for an embodiment of the present invention with reference to FIG. 2.

In FIG. 2 the column of "Belt & Drum MT" indicates an operating state of a driving motor for the intermediate transfer belt 415 and the photosensitive drum 414, the operating state being shows by an operation curve rising in synchronism to a timing when a main switch of the image forming apparatus is turned ON.

The column of "Electrified CH" shows an operating state of the electrifier 419, the operating state being shown with an operation curve rising in synchronism to a timing when a main switch of the image forming apparatus is turned ON.

The column of "Image Signal Write" shows an operating state of the optical unit 410 for writing, and indicates that an operation for optically writing is executed in the first transitional state of each waveform. In this example, the operation for optically writing is executed in the order of BK, C, M, and Y.

The column of "Primary Transfer" shows an operating state of the belt transfer section 416. AN electrifying voltage for image transfer from the photosensitive drum 414 to the intermediate transfer belt 415 is loaded in synchronism to a timing when the main switch of the image forming apparatus is turned ON.

The column of "Secondary Transfer" shows an operating state of the belt transfer section 416. Timing for transferring the BK, C, M, Y, four-color overlaid toner image in batch onto transfer paper is shown with a waveform in its first transition. The column of "Mark Detection" shows a timing for detection of the mark MC with the sensor S with a vertical line.

In FIG. 2 the point of time ① indicates a point of time when a front edge section of an electrified area on the photosensitive body 414 reaches the primary transfer section 1. Also the point of time ② indicates a timing when an operation for optically writing an image for BK as a first color is started in a certain period of time after the mark MC is detected.

As described above, detection of the mark MC by the sensor S is executed after a front edge section of an electrified area on the photosensitive drum 414 has reached the primary transfer section 1, and then an operation for writing the BK image is started, so that the contents as described above is insured.

Figure 3:
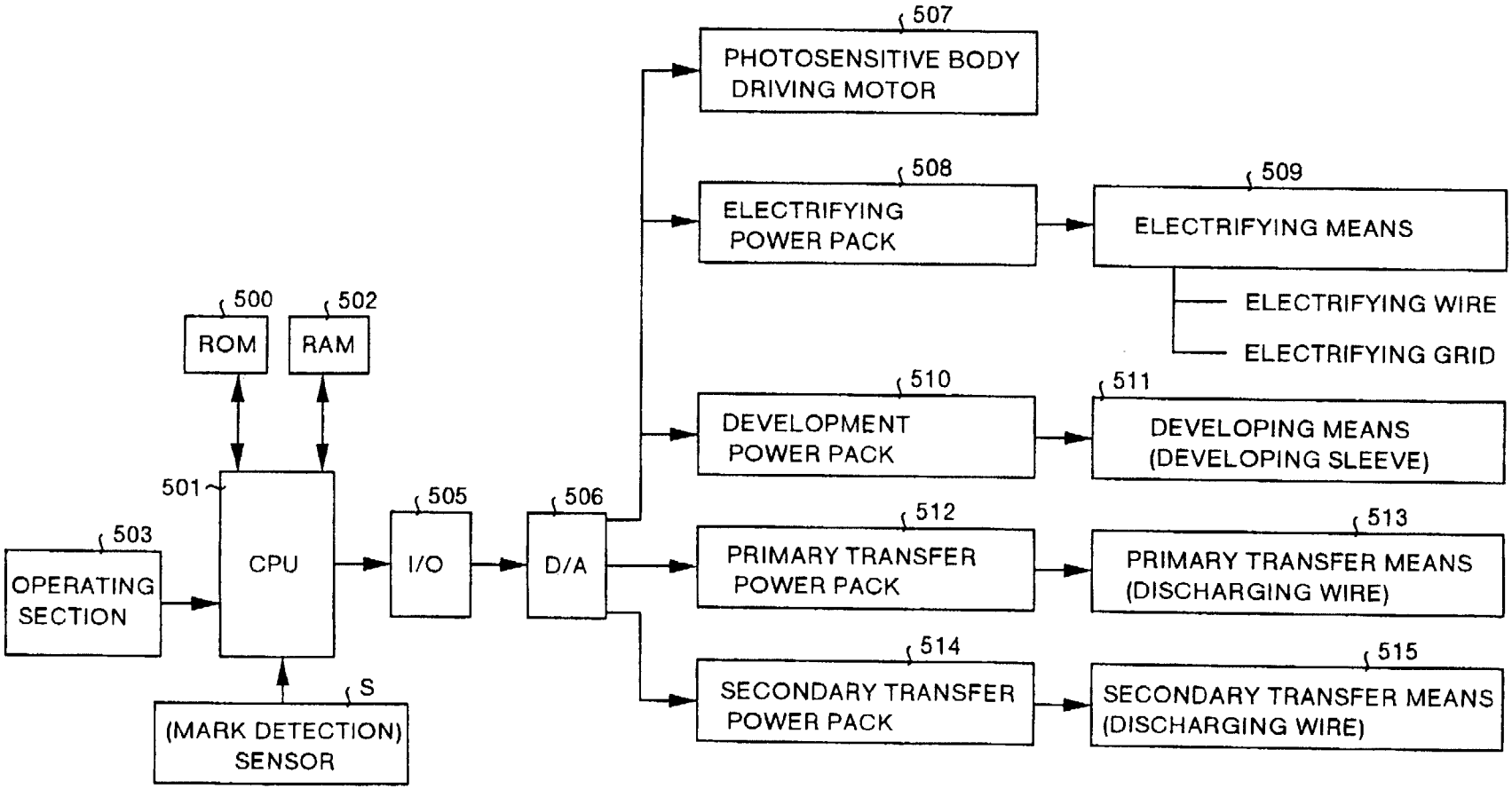
FIG. 3 is a block diagram schematically showing configuration of the image forming apparatus according to the present invention.

FIG. 3 is a block diagram schematically showing configuration of the image forming apparatus according to the present invention. In the figure, designated at the reference numeral 500 is a ROM in which a program is stored for executing control processing in each device, at 501 a CPU for executing various types of processing according to the program stored in the ROM 500, at 502 a RAM for storing results and data each processed by the CPU 501, at 503 an operating section for receiving various types of instruction signal by the CPU 501, at 505 an interface for outputting instructions for controlling or the like issued from the CPU 501 to the outside in a specified format, and at 506 a D/A converter for converting a digital signal received from the interface 505 to an analog signal, and outputting it to the outside.

Also, in the figure, designated at the reference numeral 507 is a photosensitive body driving motor for driving the photosensitive drum 414 (Refer to FIG. 12), at 508 an electrifying power pack for driving an electrifying means (electrifying wire/electrifying grid) 509, at 510 a development power pack for driving a developing means (developing sleeve) 511, at 512 a primary transfer power pack for driving a primary transfer means (discharging wire) 513, and at 514 a secondary transfer power pack for driving a secondary transfer means (discharging wire) 515.

Figure 4:
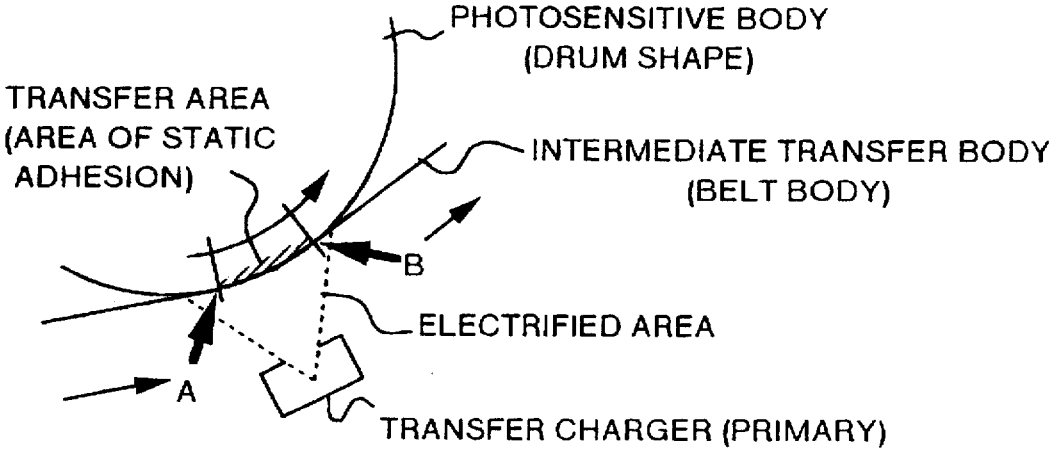
FIG. 4 is an explanatory view showing a transferred area (a case of a transfer charger) defined in the present invention.

Next description is made for a transfer area in the embodiment. FIG. 4 shows a case where the transfer means is a transfer charger (non-contact transfer means), and a primary transfer section in this case indicates a portion A of the transfer area A–B. Namely, the transfer area A–B is a contact area between the photosensitive body and intermediate transfer body, and herein, the primary transfer section A indicates a contact start point in the contact area A–B.

Figure 5:
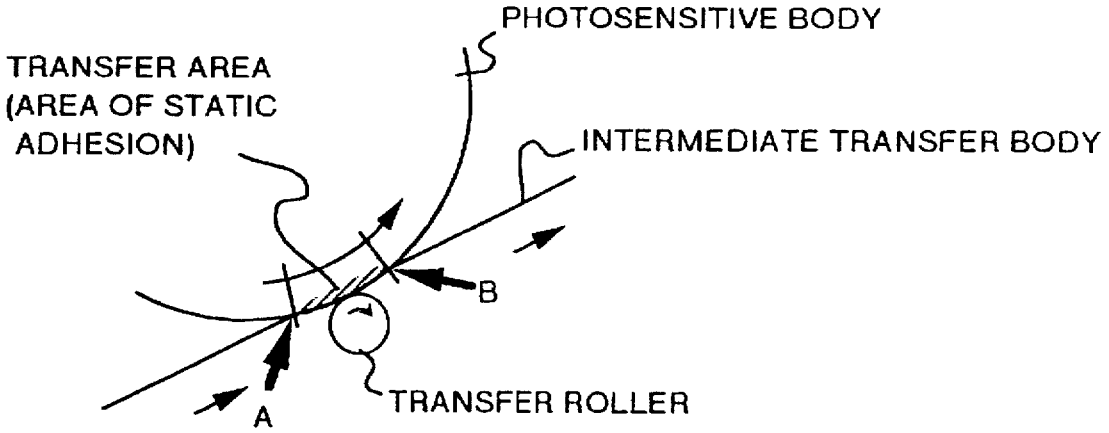
FIG. 5 is an explanatory view showing another transferred area (a case of a transfer roller) defined in the present invention.

FIG. 5 shows a case where the transfer means is a transfer roller (contact-transfer means), and the primary transfer section in this case also indicates a portion A of the transfer area A–B like that in a case of the transfer charger (non-contact transfer means). Namely, the transfer area A–B is a contact area between the photosensitive body and intermediate transfer body, and herein, the primary transfer section A indicates a contact start point in the contact area A–B. It should be noted that a transfer brush and a transfer blade other than the transfer roller shown in FIG. 5 may be used as a contact transfer means. Also, a contact position of each contact transfer means described above (transfer roller, transfer brush, transfer blade) to the intermediate transfer body may be upstream or downstream in the direction where the intermediate transfer body moves outside the transfer area A–B within an area where a Coulomb force reaches (Refer to FIG. 13).

The photosensitive body shown in FIG. 4 and FIG. 5 is a drum shape, but may be a belt shape. Furthermore, the intermediate transfer body has a belt shape, but may has a drum shape, and in this case, the intermediate transfer body may not have a discrete driving source for itself and may be rotated as the photosensitive body rotates. Also, the present embodiment may be applicable to not only the intermediate transfer body but also to a transfer belt or a transfer drum for holding and carrying a transferred material and transferring overlaid color images from the photosensitive body onto the transferred material.

Figure 6:
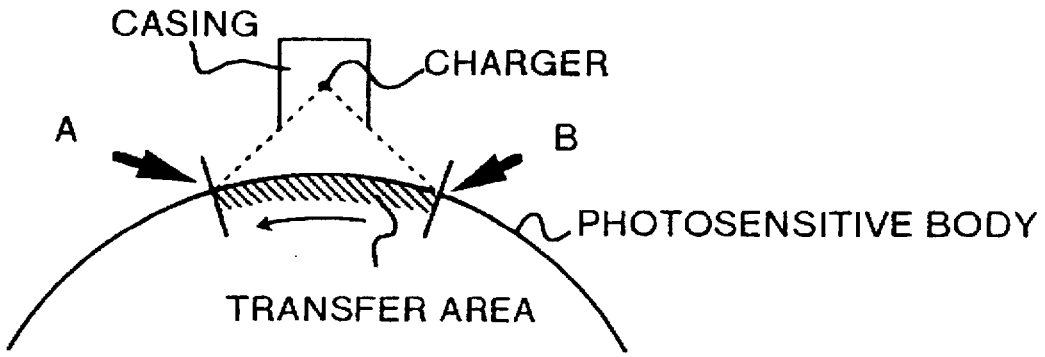
FIG. 6 is an explanatory view showing an electrifying position (a case of an electrifying charger) defined in the present invention.

Next description is made for an electrified area in the present embodiment. FIG. 6 shows a case where the electrifying means is an electrifying charger (non-contact electrifying means), and an electrifying position in this case indicates a portion A of the electrified area A–B.

Figure 7:
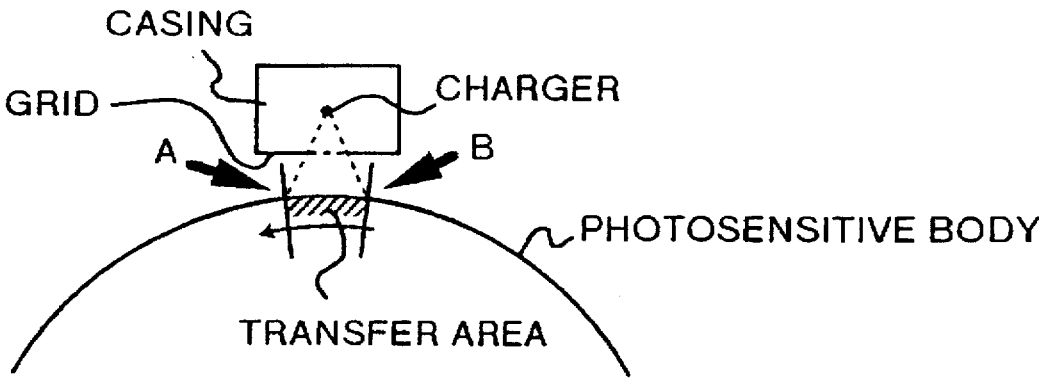
FIG. 7 is an explanatory view showing an electrifying position (a case of an electrifying charger with a grid) defined in the present invention.

FIG. 7 also shows a case where the electrifying means is an electrifying charger (non-contact electrifying means), and the electrifying charger in this case has a grid provided in a casing. With the grid provided therein, the electrified area A–B becomes narrower as compared to that shown in FIG. 6. Even in this case, the electrifying position indicates a portion A of the electrified area A–B. It should be noted that the photosensitive body may be a drum shape or a belt shape.

Figure 8:
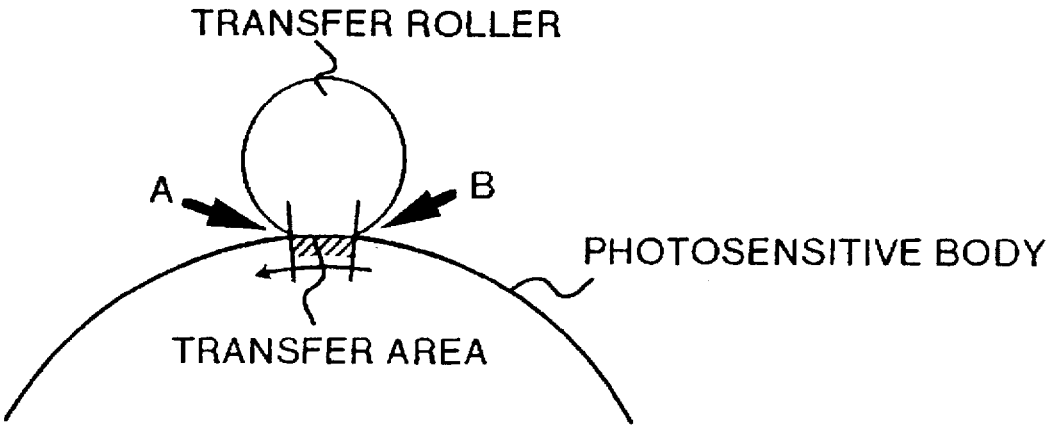
FIG. 8 is an explanatory view showing an electrifying position (a case of an electrifying roller) defined in the present invention.

FIG. 8 shows a case where the electrifying means is an electrifying roller (contact-transfer means), and the electrifying roller in this case includes, for instance, a conductive rubber roller, a conductive sponge roller, and conductive resin roller. Herein, the area A–B is a contact area between the electrifying roller and photosensitive body, and an electrifying position is a portion A as a contact start point in the contact area A–B.

Figure 9:
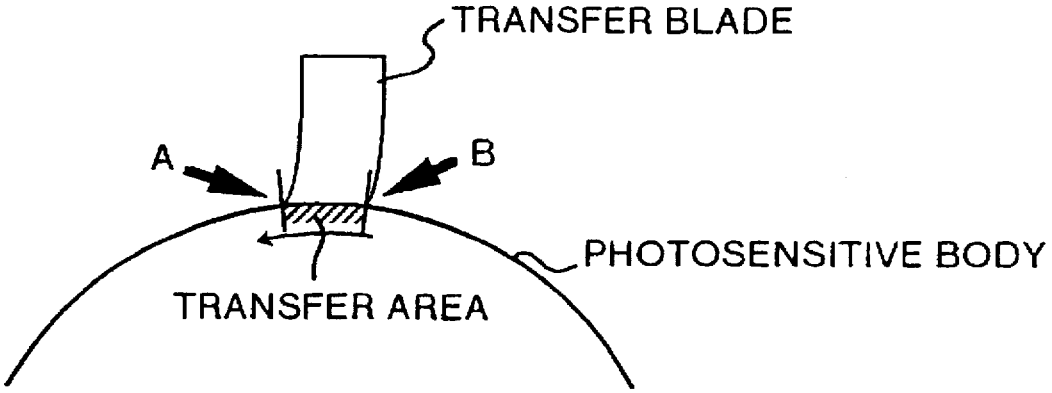
FIG. 9 is an explanatory view showing an electrifying position (a case of an electrifying blade) defined in the present invention.

FIG. 9 shows a case where the electrifying means is an electrifying blade (contact-transfer means), and the electrifying blade in this case includes ones made with, for instance, a conductive rubber, or conductive resin. Herein, the area A–B is a contact area between the electrifying blade and photosensitive body, and an electrifying position is a portion A as a contact start point in the contact area A–B.

Figure 10:
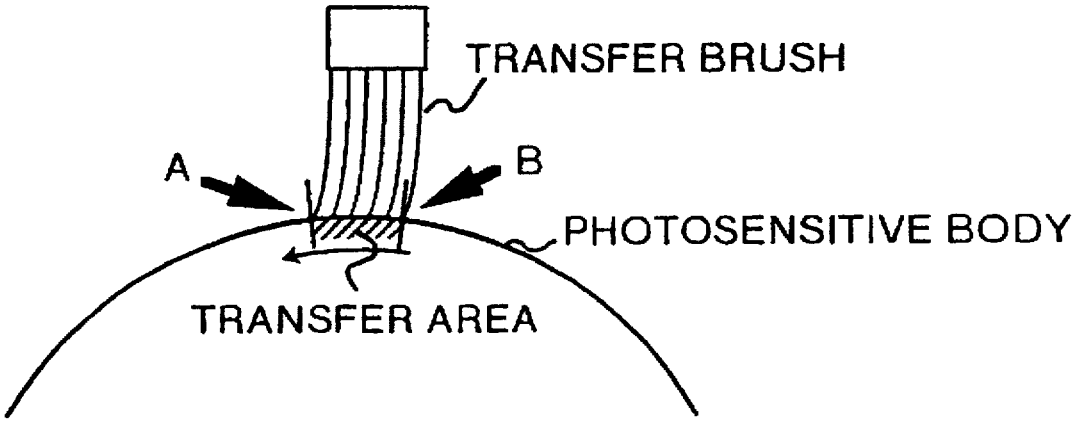
FIG. 10 is an explanatory view showing an electrifying position (a case of an electrifying blush) defined in the present invention.

FIG. 10 shows a case where the electrifying means is an electrifying brush (contact-transfer means), and herein, the area A–B is a contact area between the electrifying brush and photosensitive body, and an electrifying position is a portion A as a contact start point in the contact area A–B.

Figure 11:
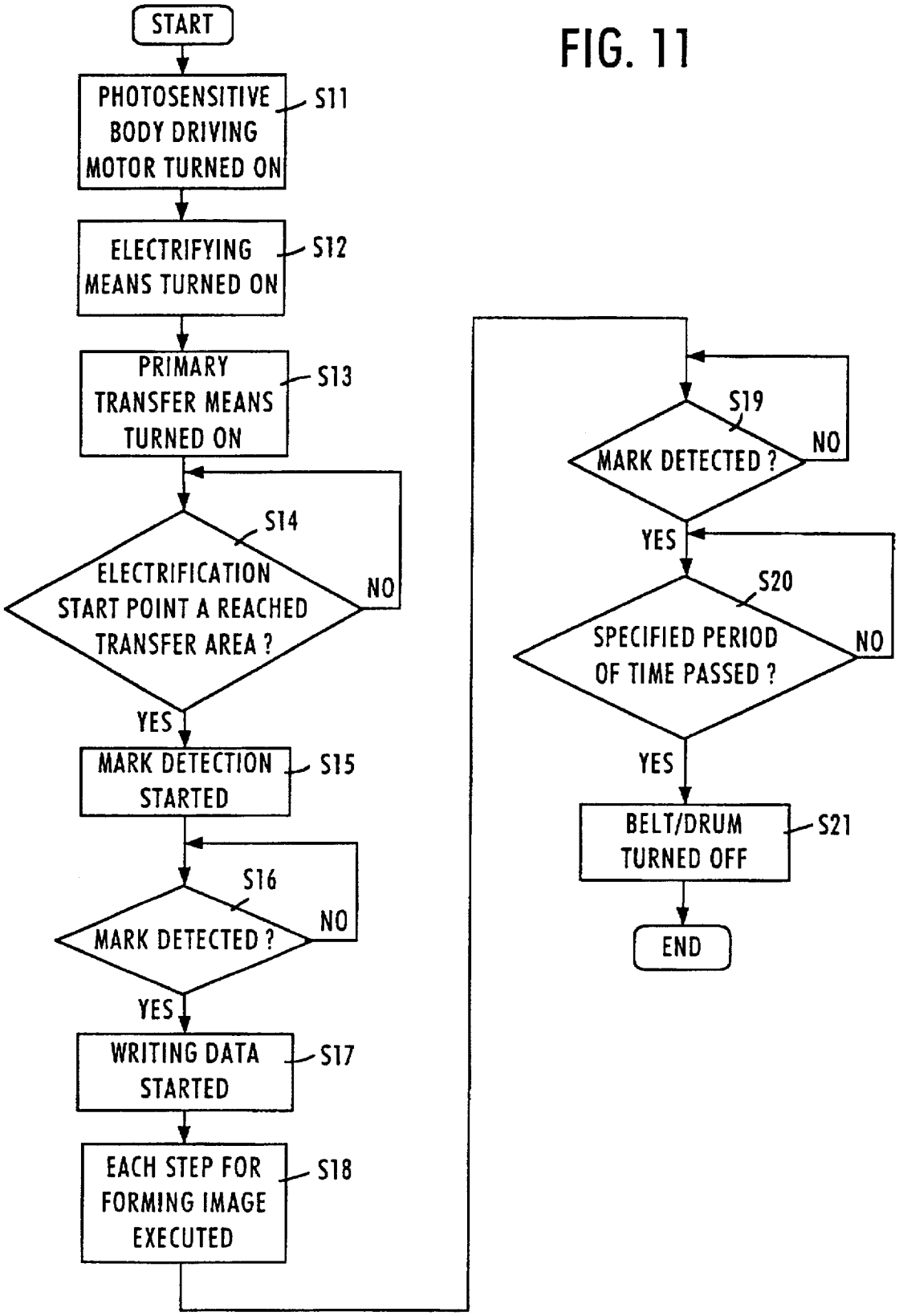
FIG. 11 is a flow chart showing operations of the image forming apparatus according to the present invention.

Next description is made for the operations in the configuration described above with reference to the flow chart shown in FIG. 11. At first, when it receives a print-key ON signal from the operating section 503 or an image formation signal, namely one of these image-formation start signals, the CPU 501 turns ON the photosensitive body driving motor 507 (S11), then turns ON the electrifying means 509 by turning ON the electrifying power pack 508 (S12). With the electrifying means 509 having been turned ON, a period of time required for an electrification start position A to reach a transfer area is computed by a counter in the CPU 501 according to a linear speed of the photosensitive body and to a distance between the electrification start position and the transfer area, and a mark detecting operation is started on its reaching or thereafter.

After the step described above, furthermore, by turning ON the primary transfer power pack 512, the CPU turns ON the primary transfer means (S13). The primary transfer means 513 may be turned ON before the electrification start point A reaches the transfer area or concurrently when the electrification start point A reaches the transfer area.

Then, determination is made as to whether the electrification start point A has reached the transfer area or not (S14), and in a case where it is determined that the electrification start point A has reached the transfer area, the mark detection is started (S15). Then, determination is made as to whether the mark has been detected or not (S16), and in a case where it is determined that the mark has been detected, an operation for writing data to the photosensitive drum 414 is started (S17), and each step for forming an image is executed (S18).

After the step described above, furthermore, determination is made as to whether the mark has been detected or not (S19), and in a case where it is determined that the mark has been detected, determination is made as to whether the specified period of time has been passed or not (S20), and in a case where it is determined that the specified period of time has been passed, the belt or the drum or the like is turned OFF (S21), and then the series of operation is finished.

Figure 13:
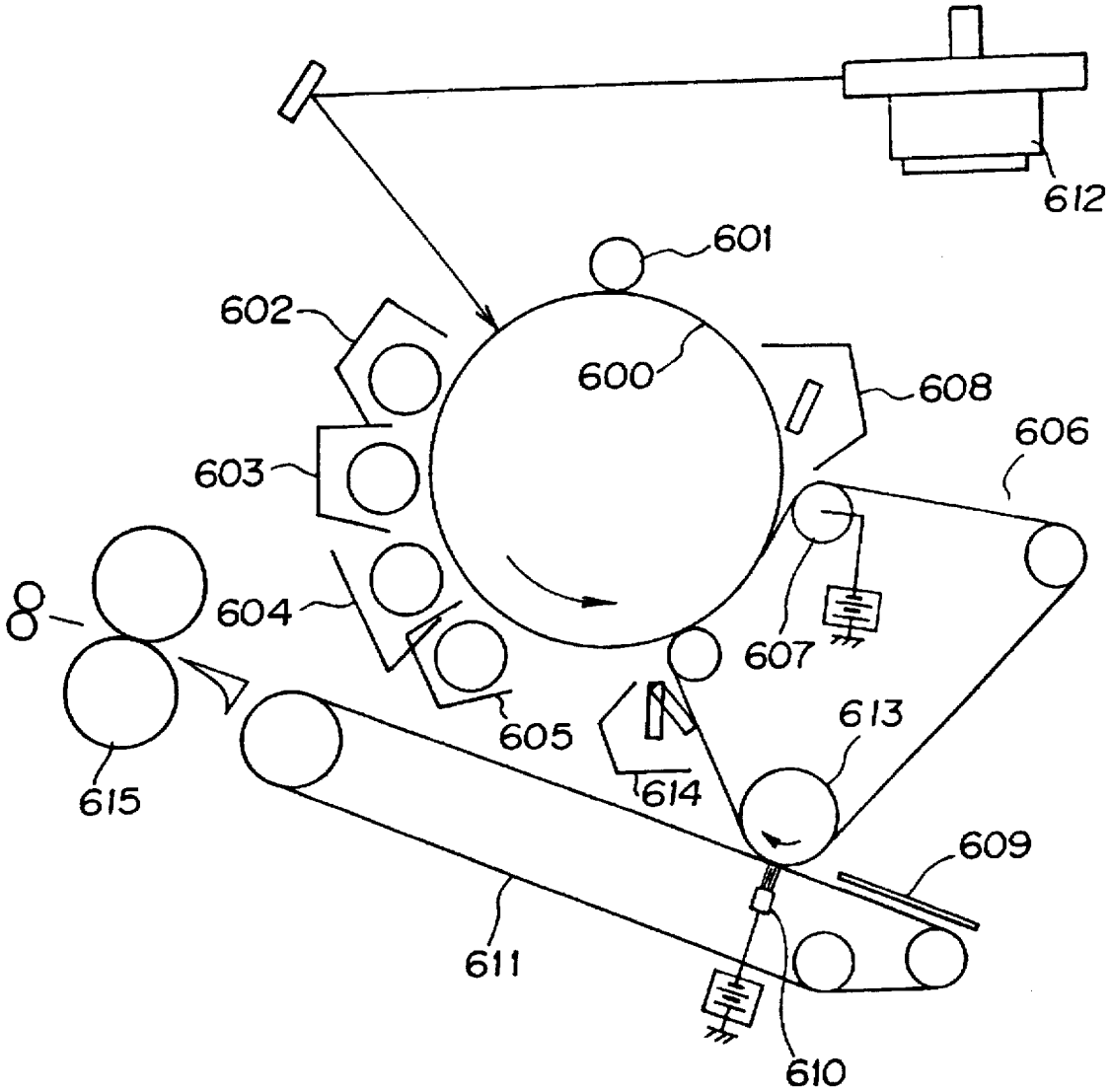
FIG. 13 is an explanatory view showing general configuration of another type of image forming apparatus preferable for carrying out the present invention.

FIG. 13 schematically shows configuration of another type of image forming apparatus to which the present invention can be applied. Provided in the periphery of a photosensitive drum (OPC) provided in the basic body of the image forming apparatus are an electrifying roller 601 for electrifying a surface of the photosensitive drum 600, a laser optical system 612 for forming a static latent image by irradiating the surface of the uniformly electrified photosensitive drum 600 with a laser beam, four developing units 602 to 605 of yellow (Y), magenta (M), cyan (C), and black (BK) for developing an electrostatic latent image and preparing the toner image, an intermediate transfer belt 606 for successively transferring the toner image with various colors formed on the photosensitive drum 600, a primary transfer roller 607 (the primary transfer roller is provided downstream in the direction and outside the transfer area to which the intermediate transfer body moves within the area which a Coulomb force reaches) for transferring the toner image on the photosensitive body 600 onto the intermediate transfer belt 606 by effecting the transfer electric field, and a cleaning device 608 for removing the residual toner on the photosensitive body 600 after the image is transferred, each successively opposing to each other.

Also, provided in the intermediate transfer belt 606 are a secondary transfer roller 613 for transferring the toner image on the belt to a transferred material 609, and a belt cleaning device 614 for removing the remains of toner on the intermediate transfer belt 606 after the image is transferred. A fixing device 615 is provided at the exit section of a transferred material carrying belt 611, away from the secondary transfer position, for carrying the transferred material 609. A secondary transfer brush for transferring the toner image on the intermediate transfer belt 606 onto the transferred material 609 is provided on the transferred material carrying belt 611.

Description is made for operations in the configuration described above. At first, the surface of the photosensitive body 600 is electrified by the electrifying roller 601, then an electrostatic latent image corresponding to the document image is formed by the laser optical system 612. After the step described above, the image is developed with each of the developing units 602 to 605, and the toner image formed on the photosensitive body is transferred onto the intermediate transfer belt 606 by the primary transfer roller 607 loaded thereinto a bias voltage having a polarity opposite to that of the toner.

The toner image transferred onto the intermediate transfer belt 606 is transferred onto the transferred material 609 carried by the transferred material carrying belt 611 with the secondary transfer roller 613 and the secondary transfer brush 610, and the image is discharged through the fixing device 615 at the exit section.

The processing control according to the present invention can be applied to the image forming apparatus having the configuration described above, and also in that case the effect can be achieved.

There is described in the above example that a period of time bt required until the mark is moved from the stopping position to a position of a sensor S is made longer by a given period of time ct than a period of time at required from a point of time when the electrifying device 419 is turned ON until a point of time when a tip section of a zone electrified by the electrifying device 419 reaches the primary transfer section 1, and the given period of time ct can include a period of time for attenuation of load fluctuation of related devices when an electrified section of the photosensitive body 414 reaches the primary transfer section 1, for instance, of load fluctuation generated due to increase of friction caused by a difference of a linear speed and a absorption force in the primary nip section of the primary transfer section 1 as a contact section between the photosensitive drum and the intermediate transfer belt. An image is optically written after the period of time for attenuation has past, so that the image is not affected by the load fluctuation generated when the image is optically written.

There is described in the above example that a period of time bt required until the mark is moved from the stopping position to a position of a sensor S is made longer by a given period of time ct than a period of time at required from a point of time when the electrifying device 419 is turned ON until a point of time when a tip section of a zone electrified by the electrifying device 419 reaches the primary transfer section 1, and the given period of time ct includes a period of time enough from a point of time when the electrified section of the photosensitive drum 414 reaches the primary transfer section 1 until a point of time when the belt transfer section 416 is turned ON and fully rises.

Otherwise, in a case where a longer period of time is required for rising of the belt transfer section 416, load fluctuation also may occur during optically writing of an image with a first color, which causes the displacements of color in an overlaid toner image.

Elimination of load fluctuation in the photosensitive body or the intermediate transfer body caused by fluctuation in an adhesion force between the photosensitive body and the intermediate transfer body, which is an object of the present invention, because the displacements of color are generated between the first color and the second color each used for forming an image not only in the four-color image forming mode but in a two-color image forming mode, can be applied to not only the example of the four-color mode described above but also a case of the two-color mode.

In the embodiment described above, the drum-shaped body is described as the photosensitive body, and the intermediate transfer belt is described as the intermediate transfer body, but the present invention is applicable to a case where a belt-shaped one is used as the photosensitive body and a drum-shaped one is used as the intermediate transfer body, and in addition to the examples, the present invention is also applicable to a given combination therebetween.

Also, the example of the belt-transfer section 416 as the primary transfer means was described above, but the present invention is applicable to not only the example described above but also to a case where a bias roller is used as the primary transfer means.

With the present invention, an electric force effecting the primary transfer section as a contact section between the photosensitive body and the intermediate transfer body can be kept constant, so that a state of load effecting the driving source for the photosensitive body and intermediate transfer body can be kept constant, whereby the image forming process goes on, which makes it possible to eliminate displacements of an image, which was a problem in the conventional technology, caused by passage of a section not electrified yet through a primary transfer section during the image forming process.

This application is based on Japanese patent application No. HEI 7-199673 filed in the Japanese Patent Office on Aug. 4, 1995, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus having a photosensitive body and an intermediate transfer body for successively transferring color toner images each formed on said photosensitive body onto said intermediate transfer body in an overlaid form to form an overlaid transfer image and transferring said overlaid transfer image in batch onto transfer paper; said image forming apparatus comprising:

a mark provided in a portion of said intermediate transfer body;

a mark detecting means provided in a passage area for said mark and detecting passage of said mark;

a primary transfer means provided in a primary transfer section constituting a state in which said primary transfer means contacts said photosensitive body;

an electrifying means provided at an electrifying position upstream in a rotating direction of said photosensitive body from a position of said primary transfer means; and a control means for providing controls so that, in a stand-by state prior to start of image forming, a distance from said mark detecting means to the mark, which is downstream of the mark detecting means with respect to a direction of rotation of the intermediate transfer body, is always kept longer in the rotating direction of said intermediate transfer body as compared to a distance in the rotating direction of said photosensitive body from said electrifying position in a downstream direction, with respect to the direction of rotation of the photosensitive body, to said primary transfer section.

2. An image forming apparatus according to claim 1; wherein said primary transfer section is a contact area where said photosensitive body and said intermediate transfer body contact each other at a contact start point.

3. An image forming apparatus according to claim 1; wherein said electrifying position is an electrification start position to the photosensitive body in a case of a non-contact electrifying system.

4. An image forming apparatus according to claim 1; wherein said electrifying position is a contact area between a contact electrifying member and the photosensitive body at a contact start point in a case of a contact-electrifying system.

5. An image forming apparatus comprising:

a photosensitive body comprising a rotating body rotated and driven;

an intermediate transfer body provided at a position opposing to said photosensitive body and rotated at a rotating speed of said photosensitive body in a state where it contacts said photosensitive body;

a mark provided in a portion of said intermediate transfer body;

a mark detecting means provided in a passage area for said mark for detecting passage of said mark;

a primary transfer means provided in the primary transfer section for constituting the state in which it contacts said photosensitive body; and an electrifying means provided at an electrifying position upstream in a direction in which said photosensitive body rotates from said primary transfer means;

and which for each color, in a certain period of time after said mark is detected by said mark detecting means during rotation of said photosensitive body and said intermediate transfer body in image forming, repeatedly starts the image forming, optically writes an image in an electrified area of said photosensitive body having passed said electrifying position and having been electrified and prepares a toner image with a given color by means of development, and then transfers said toner image with a given color in said primary transfer section with said primary transfer means onto said intermediate transfer body to obtain a toner image with various colors overlaid therein on said intermediate transfer body and transfers said color-overlaid toner image in batch onto transfer paper to obtain a color image;

wherein, assuming that in a stand-by state prior to start of said image forming, a distance from said electrifying position to said primary transfer section located downstream from the electrifying position in the direction in which said photosensitive body rotates is "a", and a distance from said mark detecting means to said mark located downstream from the electrifying means in a direction in which said intermediate transfer body rotates is "b", control is provided so that a condition of b>a is satisfied.

6. An image forming apparatus according to claim 5; wherein said primary transfer section is a contact area where said photosensitive body and said intermediate transfer body contact each other at a contact start point.

7. An image forming apparatus according to claim 5; wherein said electrifying position is an electrification start position to the photosensitive body in a case of a non-contact electrifying system.

8. An image forming apparatus according to claim 5, wherein said electrifying position is a contact area between a contact electrifying member and the photosensitive body at a contact start point in a case of a contact-electrifying system.

9. An image forming apparatus according to claim 5; wherein, when the image forming is started, a period of time bt required until said mark is moved from a stopping position to a position of said mark detecting means is longer by a given period of time ct than a period of time at required from a point of time when said electrifying means is turned ON until a point of time when a tip section of a zone electrified by said electrifying means reaches said primary transfer section.

10. An image forming apparatus according to claim 9; wherein said given period of time ct includes a period of time enough for attenuation of load fluctuation of related devices when an electrified section of said photosensitive body reaches the primary transfer section.

11. An image forming apparatus according to claim 9; wherein said given period of time ct includes a period of time from a point of time when an electrified section of said photosensitive body reaches said primary transfer section until a point of time when said primary transfer means is turned ON and fully rises.

12. An image forming apparatus according to claim 5; wherein the mark is stopped at least before start of overlaying mode.

13. An image forming apparatus according to claim 12; wherein said mark stops evading a bent section.

14. An image forming apparatus according to claim 5; wherein the mark is stopped after end of a job, when operation of a machine is down, at least before start of overlaying mode.

15. An image forming apparatus according to claim 14; wherein said mark stops evading a bent section.

16. An image forming apparatus according to claim 5; wherein the mark is stopped after power is turned ON and various types of initializing operations, and when operation of the machine is down, at least before start of a overlaying mode.

17. An image forming apparatus according to claim 16; wherein said mark stops evading a bent section.

18. An image forming method for forming an image with an image forming apparatus comprising a photosensitive body and an intermediate transfer body and which forms an overlaid transfer image by successively transferring color toner images formed on said photosensitive body onto said intermediate transfer body in an overlaid form and also transfers said overlaid images onto transfer paper in batch, said image forming apparatus comprising a mark provided in a portion of said intermediate transfer body, a mark detecting means provided in a passage area for said mark for detecting passage of said mark, a primary transfer means with a primary transfer section provided therein and constituting a stage where it contacts said photosensitive body, and an electrifying means provided at an electrifying position upstream in a direction in which said photosensitive body rotates from a position where said primary transfer means is located;

wherein control is provided so that, in a stand-by state before start of said image forming apparatus, a distance from said mark detecting means to said mark located downstream from the mark detecting means in a direction in which said intermediate transfer body rotates is always longer than a distance from said electrifying position to said primary transfer section located downstream from the electrifying position in the direction in which said photosensitive body rotates.

19. An image forming method according to claim 18; wherein said primary transfer section is a contact area between said photosensitive body and said intermediate transfer body at a contact start point.

20. An image forming method according to claim 18; wherein said electrifying position is a position at which electrification of the photosensitive body is started in a case of a non-contact electrifying system.

21. An image forming method according to claim 18; wherein said electrifying position is a contact area between a contact electrifying member and the photosensitive body at a contact start point in a case of a contact-electrifying system.

* * * * *